US012723349B2

(12) United States Patent
Oguchi et al.

(10) Patent No.: US 12,723,349 B2
(45) Date of Patent: Sep. 1, 2026

(54) PRINTING METHOD

(71) Applicant: SEIKO EPSON CORPORATION, Tokyo (JP)

(72) Inventors: Toshiaki Oguchi, Okaya (JP); Kazuki Shimura, Yamagata (JP); Takayoshi Kagata, Shiojiri (JP)

(73) Assignee: SEIKO EPSON CORPORATION (JP)

( * ) Notice: Subject to any disclaimer, the term of this patent is extended or adjusted under 35 U.S.C. 154(b) by 154 days.

(21) Appl. No.: 18/904,133

(22) Filed: Oct. 2, 2024

(65) Prior Publication Data

US 2025/0109551 A1 Apr. 3, 2025

(30) Foreign Application Priority Data

Oct. 3, 2023 (JP) ..... 2023-171916

(51) Int. Cl.

| | |
|---|---|
| ***B41J 11/00*** | (2006.01) |
| ***B41M 5/00*** | (2006.01) |
| ***D06P 1/16*** | (2006.01) |
| ***D06P 1/52*** | (2006.01) |
| ***D06P 1/54*** | (2006.01) |
| ***D06P 5/00*** | (2006.01) |

(Continued)

(52) U.S. Cl.

CPC ..... *D06P 5/005* (2013.01); *D06P 1/16* (2013.01); *D06P 1/5271* (2013.01); *D06P 1/54* (2013.01); *D06P 5/002* (2013.01); *D06P 5/30* (2013.01)

(58) Field of Classification Search

None

See application file for complete search history.

(56) References Cited

U.S. PATENT DOCUMENTS

2023/0082351 A1 3/2023 Shimura
2023/0183506 A1* 6/2023 Suzuki ..... D06P 1/5278 347/100
2023/0257589 A1* 8/2023 Kagata ..... C09B 69/06 8/445

FOREIGN PATENT DOCUMENTS

JP 2002235288 A * 8/2002
JP 2023-034579 A 3/2023

OTHER PUBLICATIONS

Kanbayashi, Machine TranslationofJP-2002235288-A, 2002 (Year: 2002).*

* cited by examiner

*Primary Examiner* — Scott A Richmond
(74) *Attorney, Agent, or Firm* — Harness, Dickey & Pierce, P.L.C.

(57) ABSTRACT

A printing method of the present disclosure includes a pre-treatment liquid adhesion step of adhering a pre-treatment liquid to a cloth and a thermal transfer step in which while a transfer medium on which an image is formed by a sublimation transfer ink jet ink containing a disperse dye and water is faced to the cloth to which the pre-treatment liquid is adhered, the image is thermal-transferred to the cloth. In the printing method described above, the pre-treatment liquid contains a polyester resin, a cross-linking agent, and water, and in the pre-treatment liquid adhesion step, the pre-treatment liquid is adhered to the cloth so that a product of a water absorbability [s] of the cloth obtained by the sedimentation method in accordance with JIS L 1907: 2010 7.1.3 and an adhesion amount [g/m$^2$] of the polyester resin to the cloth is 8.0 to 16.0 [s·g/m$^2$].

7 Claims, 3 Drawing Sheets

TABLE 3

| | EXAMPLE | | | | | | | | | | | | | | | |
|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 |
| PRE-TREATMENT LIQUID | PREPARATION EXAMPLE A1 | PREPARATION EXAMPLE A1 | PREPARATION EXAMPLE A1 | PREPARATION EXAMPLE A4 | PREPARATION EXAMPLE A5 | PREPARATION EXAMPLE A6 | PREPARATION EXAMPLE A1 | PREPARATION EXAMPLE A1 | PREPARATION EXAMPLE A1 | PREPARATION EXAMPLE A4 | PREPARATION EXAMPLE A5 | PREPARATION EXAMPLE A6 | PREPARATION EXAMPLE A1 | PREPARATION EXAMPLE A1 | PREPARATION EXAMPLE A1 | PREPARATION EXAMPLE A4 |
| CLOTH | F1 | F1 | F1 | F1 | F1 | F1 | F2 | F2 | F2 | F2 | F2 | F2 | F3 | F3 | F3 | F3 |
| ADHESION AMOUNT OF POLYESTER RESIN TO CLOTH [g/m$^2$] | 10.0 | 13.0 | 15.0 | 10.0 | 13.0 | 17.0 | 7.0 | 9.0 | 12.0 | 7.0 | 7.0 | 7.0 | 1.5 | 2.0 | 2.5 | 1.5 |
| PRODUCT OF WATER ABSORBABILITY OF CLOTH AND ADHESION AMOUNT OF POLYESTER RESIN TO CLOTH [s·g/m$^2$] | 9.0 | 11.7 | 13.5 | 9.0 | 11.7 | 15.3 | 9.1 | 11.7 | 15.6 | 9.1 | 9.1 | 9.1 | 8.1 | 10.8 | 13.5 | 8.1 |
| COLOR DEVELOPMENT PROPERTY | B | B | A | A | B | A | B | B | A | A | B | A | B | B | A | A |
| TEXTURE | A | B | B | A | A | B | A | B | B | A | A | B | A | B | B | A |
| DISCOLORATION WITH TIME | A | A | A | A | A | A | A | A | A | A | A | A | A | A | A | A |

(51) Int. Cl.
*D06P 5/28* (2006.01)
*D06P 5/30* (2006.01)

FIG. 1

TABLE 1

| | | PREPARATION EXAMPLE | | | | | |
|---|---|---|---|---|---|---|---|
| | | A1 | A2 | A3 | A4 | A5 | A6 |
| POLYESTER RESIN | KT-8803 | 4.0 | – | 4.0 | 4.0 | 2.0 | 10.0 |
| | KT-8701 | – | 4.0 | – | – | – | – |
| CROSS-LINKING AGENT | #220 | 2.0 | 2.0 | – | 2.0 | – | – |
| | K-2035E | – | – | 2.0 | – | 2.0 | 2.0 |
| ORGANIC SOLVENT | 1, 2-HEXANEDIOL | – | – | – | 15.0 | – | – |
| WATER | | 94.0 | 94.0 | 94.0 | 79.0 | 96.0 | 88.0 |

FIG. 2

TABLE 2

| | | |
|---|---|---|
| DISPERSE DYE | DB359 | 5.0 |
| WATER-SOLUBLE ORGANIC SOLVENT | PROPYLENE GLYCOL | 5.0 |
| | GLYCERIN | 10.0 |
| | TRIETHYLENE GLYCOL MONOMETHYL ETHER | 5.0 |
| SURFACTANT | BYK348 | 0.5 |
| WATER | PURE WATER | 74.5 |

FIG. 3

TABLE 3

| | EXAMPLE | | | | | | | | | | | | | | | |
|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 |
| PRE-TREATMENT LIQUID | PREPARATION EXAMPLE A1 | PREPARATION EXAMPLE A1 | PREPARATION EXAMPLE A1 | PREPARATION EXAMPLE A4 | PREPARATION EXAMPLE A5 | PREPARATION EXAMPLE A6 | PREPARATION EXAMPLE A1 | PREPARATION EXAMPLE A1 | PREPARATION EXAMPLE A1 | PREPARATION EXAMPLE A4 | PREPARATION EXAMPLE A5 | PREPARATION EXAMPLE A6 | PREPARATION EXAMPLE A1 | PREPARATION EXAMPLE A1 | PREPARATION EXAMPLE A1 | PREPARATION EXAMPLE A4 |
| CLOTH | F1 | F1 | F1 | F1 | F1 | F1 | F2 | F2 | F2 | F2 | F2 | F2 | F3 | F3 | F3 | F3 |
| ADHESION AMOUNT OF POLYESTER RESIN TO CLOTH [g/m²] | 10.0 | 13.0 | 15.0 | 10.0 | 13.0 | 17.0 | 7.0 | 9.0 | 12.0 | 7.0 | 7.0 | 7.0 | 1.5 | 2.0 | 2.5 | 1.5 |
| PRODUCT OF WATER ABSORBABILITY OF CLOTH AND ADHESION AMOUNT OF POLYESTER RESIN TO CLOTH [s·g/m²] | 9.0 | 11.7 | 13.5 | 9.0 | 11.7 | 15.3 | 9.1 | 11.7 | 15.6 | 9.1 | 9.1 | 9.1 | 8.1 | 10.8 | 13.5 | 8.1 |
| COLOR DEVELOPMENT PROPERTY | B | B | A | A | B | A | B | B | A | A | B | A | B | B | A | A |
| TEXTURE | A | B | B | A | A | B | A | B | B | A | A | B | A | B | B | A |
| DISCOLORATION WITH TIME | A | A | A | A | A | A | A | A | A | A | A | A | A | A | A | A |

FIG. 4

TABLE 4

| | EXAMPLE | | | | | | COMPARATIVE EXAMPLE | | | | | | | | |
|---|---|---|---|---|---|---|---|---|---|---|---|---|---|---|---|
| | 17 | 18 | 19 | 20 | 21 | 22 | 1 | 2 | 3 | 4 | 5 | 6 | 7 | 8 | 9 |
| PRE-TREATMENT LIQUID | PREPARATION EXAMPLE A5 | PREPARATION EXAMPLE A6 | PREPARATION EXAMPLE A2 | PREPARATION EXAMPLE A2 | PREPARATION EXAMPLE A3 | PREPARATION EXAMPLE A3 | PREPARATION EXAMPLE A1 | PREPARATION EXAMPLE A1 | PREPARATION EXAMPLE A4 | PREPARATION EXAMPLE A1 | PREPARATION EXAMPLE A1 | PREPARATION EXAMPLE A1 | PREPARATION EXAMPLE A1 | PREPARATION EXAMPLE A2 | PREPARATION EXAMPLE A3 |
| CLOTH | F3 | F3 | F1 | F1 | F1 | F1 | F1 | F1 | F1 | F2 | F2 | F3 | F3 | F1 | F1 |
| ADHESION AMOUNT OF POLYESTER RESIN TO CLOTH [g/m$^2$] | 1.5 | 1.5 | 10.0 | 15.0 | 10.0 | 15.0 | 8.0 | 20.0 | 8.0 | 5.0 | 14.0 | 1.0 | 3.5 | 20.0 | 20.0 |
| PRODUCT OF WATER ABSORBABILITY OF CLOTH AND ADHESION AMOUNT OF POLYESTER RESIN TO CLOTH [s·g/m$^2$] | 8.1 | 8.1 | 9.0 | 13.5 | 9.0 | 13.5 | 7.2 | 18.0 | 7.2 | 6.5 | 18.2 | 5.4 | 18.9 | 18.0 | 18.0 |
| COLOR DEVELOPMENT PROPERTY | B | A | C | B | C | B | E | A | D | E | A | E | A | B | B |
| TEXTURE | A | B | A | B | B | C | A | D | A | A | D | A | D | D | D |
| DISCOLORATION WITH TIME | A | A | C | C | B | B | B | A | B | B | A | B | A | B | B |

PRINTING METHOD

The present application is based on, and claims priority from JP Application Serial Number 2023-171916, filed Oct. 3, 2023, the disclosure of which is hereby incorporated by reference herein in its entirety.

BACKGROUND

1. Technical Field

The present disclosure relates to a printing method.

2. Related Art

A printing method in which a sublimation dye is transferred to a natural fiber product by heating has been used, for example, as a cloth dyeing method.

In order to more efficiently perform the transfer printing, a method in which prior to the transfer of the sublimation dye, the natural fiber product is treated by a pre-treatment liquid has been studied.

In more particular, there has been proposed a method including a step of dissolving a hot-melt type polyester resin having a glass transition temperature of 0° C. or less in a solvent selected from the group consisting of an aromatic-based ether and an aromatic-based alcohol to form a solution, a step of dispersing the solution described above in water to form an aqueous dispersion liquid, a step of adhering the aqueous dispersion liquid to a natural fiber product, a step of drying the natural fiber product, a step of mating a surface of transfer paper having a pattern formed by a sublimation dye with the surface of the natural fiber product to which the polyester resin is adhered, and a step of performing heating so as to transfer the pattern described above (see JP-A-2002-235288). JP-A-2002-235288 has disclosed that the adhesion amount of the polyester resin to the natural fiber product may be approximately 1 to 5 g/m$^2$ on a solid content basis.

However, according to JP-A-2002-235288, depending on the type of fiber, a problem in that color development and texture cannot be simultaneously satisfied may arise in some cases.

SUMMARY

The present disclosure was made to solve the problem described above and can be realized by the following aspect.

According to an aspect of the present disclosure, there is provided a printing method comprising: a pre-treatment liquid adhesion step of adhering a pre-treatment liquid to a cloth; and a thermal transfer step in which while a transfer medium on which an image is formed by a sublimation transfer ink jet ink containing a disperse dye and water is faced to the cloth to which the pre-treatment liquid is adhered, the image is thermal-transferred to the cloth. In the printing method described above, the pre-treatment liquid contains a polyester resin, a cross-linking agent, and water, and in the pre-treatment liquid adhesion step, the pre-treatment liquid is adhered to the cloth so that a product of a water absorbability [s] of the cloth obtained by the sedimentation method in accordance with JIS L 1907: 2010 7.1.3 and an adhesion amount [g/m$^2$] of the polyester resin to the cloth is 8.0 to 16.0 [s·g/m$^2$].

BRIEF DESCRIPTION OF THE DRAWINGS

FIG. 1 is a table collectively showing compositions of pre-treatment liquids prepared in Preparation Examples A1 to A6.

FIG. 2 is a table showing a composition of a sublimation transfer ink jet ink prepared in Preparation Example B1.

FIG. 3 is a table collectively showing types of pre-treatment liquids, conditions of cloths, adhesion amounts [g/m$^2$] of polyester resins to the cloths, and the like in Examples 1 to 16.

FIG. 4 is a table collectively showing types of pre-treatment liquids, conditions of cloths, adhesion amounts [g/m$^2$] of polyester resins to the cloths, and the like in Examples 17 to 22 and Comparative Examples 1 to 9.

DESCRIPTION OF EMBODIMENTS

Hereinafter, preferable embodiments of the present disclosure will be described in detail.

1 Printing Method

First, a printing method of the present disclosure will be described.

The printing method of the present disclosure includes a pre-treatment liquid adhesion step of adhering a pre-treatment liquid to a cloth and a thermal transfer step in which while a transfer medium on which an image is formed by a sublimation transfer ink jet ink containing a disperse dye and water is faced to the cloth to which the pre-treatment liquid is adhered, the image is thermal-transferred to the cloth. The pre-treatment liquid described above contains a polyester resin, a cross-linking agent, and water. In addition, in the pre-treatment liquid adhesion step, the pre-treatment liquid is adhered to the cloth so that a product of a water absorbability [s] of the cloth obtained by the sedimentation method in accordance with JIS L 1907: 2010 7.1.3 and an adhesion amount [g/m$^2$] of the polyester resin to the cloth is 8.0 to 16.0 [s·g/m$^2$]. As the value of the water absorbability [s] of the cloth obtained by the sedimentation method in accordance with JIS L 1907: 2010 7.1.3 is decreased, the water absorbability is regarded as high.

By the structure as described above, preferable printing can be performed on various types of cloths, and a printed matter excellent in color development property and texture can be obtained.

On the other hand, when the conditions as described above are not satisfied, a satisfactory result cannot be obtained.

For example, when the pre-treatment liquid adhesion step is omitted, and when the disperse dye is directly transferred to the cloth to which the pre-treatment is not performed with the pre-treatment liquid, depending on the types of cloths, the color development property of a printed matter to be obtained cannot be made sufficiently excellent.

In addition, when the pre-treatment liquid contains no cross-linking agent, the color development property of a printed matter to be obtained cannot be made sufficiently excellent. In addition, the printed matter is made inferior in terms of fastness.

In addition, when the product of the water absorbability of the cloth and the adhesion amount of the polyester resin to the cloth is less than the lower limit described above, the color development property of a printed matter to be obtained cannot be made sufficiently excellent.

In addition, when the product of the water absorbability of the cloth and the adhesion amount of the polyester resin to the cloth is more than the upper limit described above, the texture of a printed matter to be obtained cannot be made sufficiently excellent.

In addition, in the "sedimentation method in accordance with JIS L 1907: 2010 7.1.3", the followings are used as apparatuses and devices. That is, as a water bath, a bath having a size in which test pieces are not in contact with each other is used; as a stopwatch, a watch capable of measuring 0.5 seconds is used; and as water, water defined as one of A1 to A4 in Table 1 (types and qualities) of Annex 1 of JIS K 0050 is used, and the temperature thereof is set to 20° C.±2° C.

In addition, in the "sedimentation method in accordance with JIS L 1907: 2010 7.1.3", the following operation is performed. That is, 3 test pieces each having a size of 10 mm by 10 mm are obtained from a sample and are then floated in a water bath filled with water so that measurement surfaces of the test pieces face in a downward direction, and a time at which the test piece begins to sink in the water after being wetted is measured in seconds by a stopwatch. When a test piece does not sink even after 60 seconds or more, this test piece is regarded as a test piece not to sink. However, when one of the three test pieces does not sink, one test piece is additionally further obtained from the sample, and the same test as described above is again performed thereon. Among the three test pieces or the four test pieces including the additional test piece, after the three test pieces which sink within 60 seconds are picked up, the times thereof at which the test pieces begin to sink in the water after being wetted are obtained, and the average value thereof is represented by an integer value obtained in accordance with Rule B (rounding off method) of JIS Z 8401 as the test result. However, among the three test pieces or the four test pieces including the additional test piece, when at least two test pieces thereof do not sink, this sample is regarded as a sample not to sink within 60 seconds. In addition, as for a sample in which the front and the rear surfaces thereof are apparently different from each other or a sample in which the front and the rear surfaces thereof are treated by apparently different ways, the test described above is performed on each of the front and the rear surfaces described above, and the average value thereof is to be used as the value of the water absorbability.

1-1 Cloth

The cloth is in the form of a woven cloth, a knitted cloth, or a non-woven cloth made of fibers.

As the woven cloth, for example, there may be mentioned a plain weave, a twill weave, a stain weave, a change plain weave, a change twill weave, a change stain weave, a change weave, a pattern weave, a single weave, a double weave, a multi weave, a warp pile weave, a weft pile weave, or a leno weave.

The cloth may also be a processed product, such as a garment or an accessory. As the garment and the accessory, for example, there may be mentioned sewn products, such as a T shirt, a handkerchief, a scarf, a towel, a handbag, and a cloth-made bag; or furniture, such as a curtain, a sheet, a bed cover, and wallpaper.

As the fibers forming the cloth, for example, there may be mentioned natural fibers of cotton, hemp, wool, silk, leather, wood, or the like; synthetic fibers of a polypropylene, a polyester, an acetate, a triacetate, a polyamide, an acrylic resin, a polyurethane, or the like; or biodegradable fibers of a poly(lactic acid) or the like, and blended fibers using at least two types of those mentioned above may also be used.

Among those mentioned above, a cloth containing fibers formed from a material having a hydroxy group is preferable.

Accordingly, since the cross-linking agent contained in the pre-treatment liquid reacts with the hydroxy group described above, the polyester resin dyed with the disperse dye can be more tightly held on the cloth. As a result, the fastness of the printed matter, in particular, the washing fastness, the dry cleaning fastness, and the like, can be made more excellent. In addition, the texture, the color development property, and the like of the printed matter can also be made more excellent. As the fibers formed from a material having a hydroxy group, for example, cellulose fibers made of cotton, rayon, hemp, or the like may be mentioned.

For example, the cloth preferably has a basis weight of 1.0 to 10.0 Oz.

Accordingly, a preferable recording can be performed on the cloth.

As the cloth, a cloth colored with a dye in advance may also be used. Since being not likely to generate treatment marks, the pre-treatment liquid used in the present disclosure can also be applied even to a cloth colored in advance. That is, even when fabric is colored, printing capable of suppressing the generation of treatment marks can be performed, and hence, the quality and the commercial value of the printed matter as the product can be more enhanced than that in the past.

As the dye to color the cloth in advance, for example, there may be mentioned a water-soluble dye, such as an acidic dye or a basic dye; a disperse dye to be used with a dispersant; a reactive dye; or a solvent dye. When a cotton cloth is used as the cloth, a disperse dye or a reactive dye suitable for cotton dyeing is preferably used, and a disperse dye is more preferably used.

By the difference in conditions as described above, the water absorbability of the cloth, that is, the water absorbability [s] of the cloth obtained by the sedimentation method in accordance with JIS L 1907: 2010 7.1.3, is made different.

1-2 Pre-Treatment Liquid Adhesion Step

In the pre-treatment liquid adhesion step, a pre-treatment liquid containing a polyester resin, a cross-linking agent, and water is adhered to the cloth.

In addition, in the pre-treatment liquid adhesion step, the pre-treatment liquid is adhered to the cloth so that the product of the water absorbability [s] of the cloth obtained by the sedimentation method in accordance with JIS L 1907: 2010 7.1.3 and the adhesion amount [$g/m^2$] of the polyester resin to the cloth is 8.0 to 16.0 [$s \cdot g/m^2$].

As described above, in the present disclosure, although the pre-treatment liquid is adhered to the cloth in the pre-treatment liquid adhesion step so that the product of the water absorbability [s] of the cloth obtained by the sedimentation method in accordance with JIS L 1907: 2010 7.1.3 and the adhesion amount [$g/m^2$] of the polyester resin to the cloth is 8.0 to 16.0 [$s \cdot g/m^2$], the product of the water absorbability [s] of the cloth and the adhesion amount [$g/m^2$] of the polyester resin to the cloth preferably satisfies the following conditions. That is, the product of the water absorbability [s] of the cloth and the adhesion amount [$g/m^2$] of the polyester resin to the cloth is preferably 8.1 to 15.8 [$s \cdot g/m^2$], more preferably 8.1 to 14.0 [$s \cdot g/m^2$], and further preferably 8.1 to 13.6 [$s \cdot g/m^2$].

Accordingly, the effects of the present disclosure described above can be more significantly obtained.

1-2-1 Pre-Treatment Liquid

Next, the pre-treatment liquid will be described in detail.

1-2-1-1 Polyester

The pre-treatment liquid contains a polyester resin.

Among various types of resins, since a polyester resin is used, the fastness of the printed matter, in particular, the washing fastness, the dry cleaning fastness, and the like, can be made more excellent. In addition, the texture, the color development property, and the like of the printed matter can also be made more excellent.

The polyester resin is a resin having a structural unit derived from a polyvalent carboxylic acid and a structural unit derived from a polyvalent alcohol.

As the polyvalent carboxylic acid, for example, there may be mentioned terephthalic acid, isophthalic acid, orthophthalic acid, a phthalic acid, 4,4'-diphenyl dicarboxylic acid, 2,5-naphthalen dicarboxylic acid, 1,5-naphthalen dicarboxylic acid, 2,6-naphthalen dicarboxylic acid, 2,7-naphthalen dicarboxylic acid, 1,4-cyclohexane dicarboxylic acid, 2-potassium sulfoterephthalic acid, 5-sodium sulfoisophthalic acid, adipic acid, azelaic acid, sebacic acid, dodecane dicarboxylic acid, glutaric acid, succinic acid, trimellitic acid, trimesic acid, pyromellitic acid, trimellitic anhydride, phthalic anhydride, succinic anhydride, p-hydroxy benzoic acid, or a salt thereof. As the salt, for example, a potassium salt, a sodium salt, a calcium salt, or a magnesium salt may be mentioned.

As the polyalcohol, for example, there may be mentioned ethylene glycol, 1,2-propylene glycol, 1,3-propanediol, 1,3-butylene glycol, 1,4-butanediol, 1,6-hexanediol, 2-methyl-1,5-pentanediol, neopentyl glycol, 1,4-cyclohexane dimethanol, p-xylylene glycol, a bisphenol A-ethylene glycol adduct, diethylene glycol, triethylene glycol, a polyethylene glycol, a polypropylene glycol, a polytetramethylene glycol, a polytetramethylene oxide glycol, dimethylol propionic acid, glycerin, trimethylol propane, sodium dimethylolethyl sulfonate, potassium dimethylolethyl sulfonate, or potassium dimethylol propionate, and those mentioned above may be used alone, or at least two types selected therefrom may be used in combination.

The polyester resin preferably has a hydroxy group, a carboxy group, and a sulfonic acid group and also preferably has sodium salts thereof.

As a sulfonic acid group-containing polyester resin, for example, there may be mentioned a resin having a structural unit derived from a polyvalent carboxylic acid, a structural unit derived from a polyvalent alcohol, and a structural unit derived from a sulfonic acid group-containing aromatic monomer.

As the sulfonic acid group-containing aromatic monomer, for example, there may be mentioned 5-suloisophthalic acid, sulfoterephthalic acid, 4-sulfophhtalic acid, 4-sulfonaphthalene-2,7-dicarboxylic acid, 4-sulfo-1,8-naphthalene dicarboxylic anhydride, or a salt thereof, and at least one selected from the group consisting of those mentioned above may be used in combination. As the salt thereof, for example, although a potassium salt, a sodium salt, a calcium salt, or a magnesium salt may be mentioned, a sodium salt is preferable.

Since having the functional groups described above, the polyester resin is able to preferably react with a cross-linking agent, and a binding property to the cloth can be made more preferable. As a result, the fastness of the printed matter, in particular, the washing fastness, the dry cleaning fastness, and the like, can be made more excellent. In addition, the texture, the color development property, and the like of the printed matter can also be made more excellent. When the cross-linking agent is an isocyanate group-containing compound, and/or when the cloth contains fibers formed of a material having a hydroxy group, the effects as described above can be more significantly obtained.

The polyester resin can be obtained, for example, by a general polycondensation reaction using at least one selected from the polyvalent carboxylic acids, at least one selected from the polyvalent alcohols, and, if needed, at least one selected from the sulfonic acid group-containing aromatic monomers.

As the polyester resin as described above, a commercial product may also be used. As the commercial product, for example, there may be mentioned Elitel (registered trademark) KA-5071s, KT-8803, KT-9204, KT-8701, KT-8904, or KT-0507 (trade name, manufactured by Unitika Ltd., polyester resin emulsion); Hitec (registered trademark) SN-2002 (trade name, manufactured by Toho Chemical Industry Co., Ltd., polyester resin emulsion); Plascoat (registered trademark) Z-221, Z-446, Z-561, Z-565, RZ-570, Z-592, Z-687, Z-690, Z-730, Z-760, RZ-105, RZ-570, or RZ-760 (trade name, manufactured by Goo Chemical Co., Ltd.); or Bironal (registered trademark) MD-1200, MD-1500, or MD-2000 (trade name, manufactured by Toyobo Co., Ltd.).

The polyester resin has a glass transition temperature of preferably 25° C. or more, more preferably 35° C. to 90° C., and further preferably 45° C. to 80° C.

Accordingly, in a use temperature range of the printed matter obtained by the printing method of the present disclosure, the molecular motion of the polyester resin can be reduced, and the disperse dye can be more preferably held in the polyester resin. As a result, the color development property of the printed matter can be made more excellent, and discoloration with time can be more preferably suppressed.

In the pre-treatment liquid, although the state of the polyester resin thus contained is not particularly limited, and for example, the polyester resin may be contained in a dissolved state, the polyester resin is preferably formed of particles and contained in a dispersed state.

A content of the polyester resin in the pre-treatment liquid is preferably 1.0 to 20.0 percent by mass, more preferably 2.0 to 15.0 percent by mass, and further preferably 2.0 to 10.0 percent by mass.

Accordingly, the fastness, the texture, and the color development property of the printed matter can be obtained with a more preferable balance.

1-2-1-2 Cross-Linking Agent

The pre-treatment liquid contains a cross-linking agent.

Accordingly, a cross-linking property can be imparted to the pre-treatment liquid, and hence, the polyester resin, the disperse dye, and the cloth can be preferably bound to each other. As a result, a printed matter excellent in color development property and fastness can be obtained.

As the cross-linking agent, an agent appropriately selected from known cross-linking agents can be used, and either an agent to initiate a cross-linking reaction at ordinary temperature or an agent to initiate a cross-linking reaction by heat may be used. As the cross-linking agent as described above, for example, although a cross-linking agent having a self-cross linking property, a compound having a plurality of functional groups to react with unsaturated carboxylic acid components in its molecule, or a metal having a polyvalent coordination site may be mentioned, at least one selected from the group consisting of an isocyanate group-containing compound and an oxazoline group-containing compound is preferable, and an isocyanate group-containing compound is more preferable.

Accordingly, the fastness, the texture, and the color development property of the printed matter can be obtained with a more preferable balance.

As the isocyanate group-containing compound, for example, a water dispersible (blocked) polyisocyanate may be mentioned. In addition, the (blocked) polyisocyanate represents a polyisocyanate and/or a blocked polyisocyanate. Those isocyanate group-containing compounds may be used alone, or at least two types thereof may be used in combination.

As the water dispersible (blocked) polyisocyanate, for example, there may be mentioned a compound in which a polyisocyanate imparted with a hydrophilic property by a poly(ethylene oxide) chain is dispersed in water using an anionic dispersant or a non-anionic dispersant.

As the polyisocyanate, for example, there may be mentioned a diisocyanate, such as hexamethylenediisocyanate or isophoronediisocyanate; or a derivative (modified compound) of a polyisocyanate, such as a trimethylolpropane adduct, a burette, or an isocyanurate, of one the diisocyanates mentioned above. In addition, the polyisocyanate may have an isocyanurate skeleton in its structure. Those polyisocyanates may be used alone, or at least two types thereof may be used in combination.

The water dispersible blocked polyisocyanate is a water dispersible polyisocyanate in which the isocyanate group is blocked by a blocking agent. As the blocking agent, for example, diethyl malonate, ethyl acetoacetate, ε-caprolactam, butanone oxime, cyclohexanone oxime, 1,2,4-triazole, dimethyl-1,2,4-triazole, 3,5-dimethylpyrazole, or imidazole may be mentioned. Those blocking agents may be used alone, or at least two types thereof may be used in combination.

As the cross-linking agent, an isocyanate group-containing compound having an isocyanurate skeleton in its structure is preferable, and a water-dispersible polyisocyanate having an isocyanurate skeleton in its structure is more preferable. Since having at least three cross-linking points in its molecule, the isocyanate group-containing compound having an isocyanurate skeleton is able to have a more preferable binding property between the polyester resin and the cloth. As a result, the fastness, the texture, and the color development property of the printed matter can be obtained with a more preferable balance.

As the isocyanate group-containing compound as described above, a commercial product may also be used. As the commercial product, for example, there may be mentioned Fixer #100ECO, #104EA, #220, 70ECO, #70, #410, or #400 (trade name, manufactured by Murayama Chemical Laboratory Co., Ltd.); or Elastron (registered trademark) BN-11, BN-27, BN-69, or BN-77 (trade name, manufactured by DKS Co., Ltd.).

As the oxazoline group-containing compound, for example, a compound having at least two oxazoline groups in its molecule may be mentioned. As the oxazoline group-containing compound as described above, for example, there may be mentioned 2,2'-bis(2-oxazoline), 2,2'-methylene-bis(2-oxazoline), 2,2'-ethylene-bis(2-oxazoline), 2,2'-trimethylene-bis(2-oxazoline), 2,2'-tetramethylene-bis(2-oxazoline), 2,2'-hexamethylene-bis(2-oxazoline), 2,2'-octamethylene-bis(2-oxazoline), 2,2'-ethylene-bis(4,4'-dimethyl-2-oxazoline), 2,2'-p-phenylene-bis(2-oxazoline), 2,2'-m-phenylene-bis(2-oxazoline), 2,2'-m-phenylene-bis(4,4'-dimethyl-2-oxazoline), bis(2-oxazolinylcyclohexane)sulfide, bis(2-oxazolinylnorbornane)sulfide, or an oxazoline ring-containing polymer. In addition, although at least one selected from the compounds mentioned above may be used in combination, a water-soluble oxazoline group-containing compound is preferably contained.

Accordingly, the fastness, the texture, and the color development property of the printed matter can be obtained with a more preferable balance.

As the oxazoline group-containing compound as described above, a commercial product may also be used. As the commercial product, for example, Epocros (registered trademark) K-2010, K-2020, K-2030, K-2035E, WS-300, WS-500, or WS-700 (trade name, manufactured by Nippon Shokubai Co., Ltd.) may be mentioned.

The cross-linking agent may be used alone, or at least two types thereof may be used in combination.

A content of the cross-linking agent in the pre-treatment liquid is preferably 0.1 to 5.0 percent by mass and more preferably 0.5 to 3.0 percent by mass.

Accordingly, when various types of cloths are used, the fastness, the texture, and the color development property of the printed matter can be obtained with a more preferable balance.

1-2-1-3 Water

The pre-treatment liquid contains water.

The water is a component to impart fluidity to the pre-treatment liquid.

After the pre-treatment liquid is adhered to the cloth, the water is mostly evaporated and scattered.

As the water, for example, there may be mentioned pure water, such as ion exchange water, ultrafiltration water, reverse osmosis water, or distilled water, or water, such as ultrapure water, in which ionic impurities are removed as much as possible. In addition, when the pre-treatment liquid is stored for a long time, water sterilized by UV radiation, addition of hydrogen peroxide, or the like is preferable since generation of fungi and bacteria can be suppressed.

A content of the water in the pre-treatment liquid is preferably 30.0 to 98.0 percent by mass, more preferably 35.0 to 96.0 percent by mass, and further preferably 40.0 to 94.0 percent by mass.

Accordingly, an increase in viscosity of the pre-treatment liquid can be suppressed, and a workability when the pre-treatment liquid is adhered to the cloth and a drying property after the adhesion can be made more excellent. In addition, the pre-treatment liquid is able to have a high affinity to a cloth including fibers having a hydroxy group.

1-2-1-4 Organic Solvent

The pre-treatment liquid may further contain an organic solvent.

Accordingly, a permeability of the pre-treatment liquid to the cloth is improved, and hence, the color development property can be made more excellent.

As the organic solvent, for example, there may be mentioned glycerin, a glycol, a glycol ether, a nitrogen-containing solvent, an ester, a cyclic ester, or a monool, and although at least one selected from those mentioned above may be used in combination, at least one selected from the group consisting of a glycol, a glycol ether, and a nitrogen-containing solvent is preferably used.

Accordingly, the fastness, the texture, and the color development property of the printed matter can be obtained with a more preferable balance.

The organic solvent has a boiling point of preferably 100° C. or more, more preferably 110° C. to 300° C., and further more preferably 120° C. to 289° C.

Accordingly, the fastness, the texture, and the color development property of the printed matter can be obtained with a more preferable balance.

In addition, in this specification, unless otherwise particularly noted, the boiling point represents a boiling point at a standard atmospheric pressure of 1,013.25 hPa, that is, represents the standard boiling point.

The organic solvent has an SP value of preferably 13.5 or less, more preferably 7.0 to 13.0, and further preferably 8.0 to 12.5.

Accordingly, a compatibility between the organic solvent and the disperse dye contained in the sublimation transfer ink jet ink can be enhanced; in the thermal transfer step, the disperse dye can be more preferably dissolved in an organic solvent remaining in the vicinity of the cloth; and the polyester resin can be more preferably dyed in the vicinity of the cloth. As a result, the fastness, the texture, and the color development property of the printed matter can be obtained with a more preferable balance.

In addition, in this specification, the SP value is a solubility parameter based on Hansen Method and is also called a Hansen SP value. In Hansen method, the SP value δ is classified into the three terms so that $\delta^2=\delta_d^2+\delta_p^2+\delta_h^2$ holds. $\delta_d$, $\delta_p$, and $\delta_h$ represent solubility parameters corresponding to the dispersion term, the dipole term, and the hydrogen bonding term, respectively. The units of the SP value and the Hansen SP value are each $(cal/cm^3)^{1/2}$. As the Hansen SP value, for example, a value calculated using Hansen-Solubility HSPiP which is calculation software may also be used.

As the glycol, for example, there may be mentioned ethylene glycol, triethylene glycol (SP value: 13.5, standard boiling point: 287° C.), 1,2-hexanediol (SP value: 12.1, standard boiling point: 170° C.), diethylene glycol (SP value: 12.1, standard boiling point: 245° C.), dipropylene glycol (SP value: 12.1, standard boiling point: 231° C.), 1,3-butandiol (SP value: 11.6, standard boiling point: 207° C.), 1,6-hexanediol (SP value: 12.3, standard boiling point: 250° C.), tetraethylene glycol (SP value: 12.3, standard boiling point: 314° C.), or 2-ethyl-1,3-hexanediol (SP value: 11.3, standard boiling point: 244° C.).

As the glycol ether, for example, there may be mentioned dipropylene glycol monomethyl ether (SP value: 10.1, standard boiling point: 188° C.), dipropylene glycol dimethyl ether (SP value: 8.4, standard boiling point: 171° C.), triethylene glycol monobutyl ether (SP value: 10.0, standard boiling point: 278° C.), ethylene glycol diethyl ether (SP value: 8.3, standard boiling point: 189° C.), ethylene glycol monoethyl ether (SP value: 10.5, standard boiling point: 135° C.), ethylene glycol monophenyl ether (SP value: 11.5, standard boiling point: 245° C.), ethylene glycol monobutyl ether (SP value: 9.5, standard boiling point: 171° C.), ethylene glycol monobenzyl ether (SP value: 10.9, standard boiling point: 256° C.), ethylene glycol monomethyl ether (SP value: 11.4, standard boiling point: 124° C.), diethylene glycol monoethyl ether (SP value: 10.2, standard boiling point: 202° C.), diethylene glycol monobutyl ether (SP value: 10.0, standard boiling point: 231° C.), triethylene glycol monomethyl ether (SP value: 10.5, standard boiling point: 248° C.), or propylene glycol monomethyl ether (SP value: 10.0, standard boiling point: 121° C.).

As the nitrogen-containing solvent, for example, there may be mentioned 2-pyrrolidone (SP value: 11.5, standard boiling point: 245° C.), dimethylformamide (SP value: 12.2, standard boiling point: 153° C.), N-methyl-2-pyrrolidone (SP value: 11.2, standard boiling point: 202° C.), or aniline (SP value: 11.6, standard boiling point: 184° C.).

As the ester, for example, there may be mentioned ethylene glycol diacetate (SP value: 10.0, standard boiling point: 190° C.), ethylene glycol monomethyl ether acetate (SP value: 9.2, standard boiling point: 145° C.), diethylene glycol monobutyl ether acetate (SP value: 8.5, standard boiling point: 246° C.), allyl acetate (SP value: 9.2, standard boiling point: 103° C.), or butyl acetate (SP value: 8.5, standard boiling point: 126° C.).

As the cyclic ester, for example, ε-caprolactone (SP value: 10.1, standard boiling point: 241° C.) may be mentioned.

As the monool, for example, there may be mentioned methanol, ethanol, 1-butanol (SP value: 11.3, standard boiling point: 118° C.), 2-ethyl-1-hexanol (SP value: 9.5, standard boiling point: 185° C.), or 3-buten-1-ol (SP value: 11.0, standard boiling point: 114° C.).

Among those mentioned above, as the organic solvent, at least one selected from the group consisting of triethylene glycol, dipropylene glycol monomethyl ether, dipropylene glycol dimethyl ether, triethylene glycol monobutyl ether, and 2-pyrrolidone is preferably contained.

Accordingly, the fastness, the texture, and the color development property of the printed matter can be obtained with a more preferable balance.

A content of the organic solvent in the pre-treatment liquid is preferably 5.0 percent by mass or more, more preferably 5.0 to 70.0 percent by mass, further preferably 10.0 to 55.0 percent by mass, and particularly preferably 15.0 to 45.0 percent by mass.

Accordingly, the fastness, the texture, and the color development property of the printed matter can be obtained with a more preferable balance.

1-2-1-5 Other Components

The pre-treatment liquid may further contain components other than those described above. Hereinafter, in this section, the components as described above are called "other components".

As the other components, for example, there may be mentioned a surfactant, a solubilizing agent, a viscosity adjuster, a pH adjuster, an antioxidant, an antiseptic agent, a fungicide, a corrosion inhibitor, and/or a chelating agent.

As the antiseptic agent, for example, there may be mentioned sodium pentachlorophenol, sodium-2-pyridinethiol-1-oxide, or 1,2-dibenzinethiazoline-3-one.

As the fungicide, a commercial product may also be used. As the commercial product, for example, Proxel (registered trademark) Series, CRL, BND, GXL, XL-2, or TN (trade name, manufactured by Lonza Japan) may be mentioned.

However, a content of the other components in the pre-treatment liquid is preferably 10.0 percent by mass or less, more preferably 7.0 percent by mass or less, and further preferably 5.0 percent by mass or less.

1-2-1-6 Other Conditions

The pre-treatment liquid preferably satisfies the following conditions.

1-2-1-6-1 Viscosity

The pre-treatment liquid preferably has a viscosity of 1.5 to 100 mPa·s at 20° C.

Accordingly, when the pre-treatment liquid is adhered to the cloth, a coatability, such as a spreadability, of the pre-treatment liquid can be made more excellent.

In addition, the viscosity of the pre-treatment liquid is measured, for example, using a viscoelastic test machine MCR-300 (manufactured by Pysica). In more particular, the temperature of the pre-treatment liquid is controlled at 20° C., and a shear viscosity [mPa·s] at a shear rate of 200 [1/s] is read for the measurement.

1-2-1-6-2 Surface Tension

The pre-treatment liquid preferably has a surface tension of 30 to 50 mN/m at 25° C.

Accordingly, the wettability and the permeability of the pre-treatment liquid to the cloth can be made more appropriate. In addition, since the pre-treatment liquid is likely to be uniformly absorbed in the cloth, generation in difference of the adhesion amount that occurs when the pre-treatment liquid is applied, that is, coating unevenness, can be more effectively suppressed.

In addition, the surface tension of the pre-treatment liquid may be measured, for example, using an automatic surface tensiometer CBVP-Z (manufactured by Kyowa Interface Science Co., Ltd.). In more particular, in an environment at a temperature of 25° C., a surface tension obtained when a platinum plate is wetted with the pre-treatment liquid is read for the measurement.

1-2-1-7 Preparation Method of Pre-Treatment Liquid

The pre-treatment liquid may be prepared by mixing the components in an arbitrary order.

The mixture thus obtained may be treated, if needed, by filtration or the like so as to remove impurities, foreign substances, and the like.

As a mixing method of the components, for example, there may be used a method in which after the components are sequentially added in a container equipped with a stirring device, such as a mechanical stirrer or a magnetic stirrer, mixing and stirring are performed. As a filtration method, for example, a centrifugal filtration or a filter filtration may be mentioned.

1-2-2 Adhesion Condition

As a method to adhere the pre-treatment liquid to the cloth, for example, there may be mentioned an immersion coating method in which the cloth is immersed in the pre-treatment liquid, a roller coating method in which the pre-treatment liquid is applied by a mangle roller or a roll coater, a spray coating method in which the pre-treatment liquid is sprayed by a spray device or the like, or an ink jet coating method in which the pre-treatment liquid is sprayed by an ink jet method, and although at least one selected from those mentioned above may be used in combination, a roller coating method is preferable.

Accordingly, the degree of design freedom of the adhesion amount of the pre-treatment liquid is increased, and defects are not likely to occur when the pre-treatment liquid is adhered; hence, the pre-treatment liquid can be more uniformly adhered to the cloth.

The adhesion amount of the pre-treatment liquid per unit area of the cloth is preferably 0.02 to 0.5 g/cm$^2$ and more preferably 0.02 to 0.3 g/cm$^2$.

Accordingly, the pre-treatment liquid can be more uniformly adhered to the cloth, aggregation unevenness of an image of the printed matter can be more effectively suppressed, and hence, the color development property can be enhanced.

1-3 Thermal Transfer Step

In the thermal transfer step, after a transfer medium on which an image is formed by the sublimation transfer ink jet ink containing a disperse dye and water is faced to the cloth to which the pre-treatment liquid is adhered in the pre-treatment liquid adhesion step described above, the image is thermal-transferred to the cloth.

Accordingly, the disperse dye is transferred to the cloth which is treated by the pre-treatment liquid adhesion step, so that the printed matter is obtained.

In this step, while the transfer medium on which the image is formed by the sublimation transfer ink jet ink is faced to the cloth to which the pre-treatment liquid described above is adhered, the heating may be performed. In this step, in the state in which the transfer medium and the cloth treated by the pre-treatment liquid adhesion step are placed in close contact with each other, the heating is more preferably performed. Accordingly, for example, a clearer image can be recorded on the cloth treated by the pre-treatment liquid adhesion step, that is, can be dyed thereon.

As the heating method, for example, although steaming with vapor, a heat press with dry heat, a thermosol, a HT steamer with superheated vapor, or a HP steamer with pressurized vapor may be mentioned, a method using dry heat is preferable.

Accordingly, the fastness, the texture, and the color development property of the printed matter can be obtained with a more preferable balance.

A heating temperature in this step is preferably 160° C. to 220° C. and more preferably 190° C. to 210° C.

Accordingly, energy necessary for the transfer can be further reduced, and a productivity of the printed matter can be made more excellent. In addition, the color development property of the printed matter can also be made more excellent.

Although depending on the heating temperature, a heating time is preferably 30 to 120 seconds and more preferably 40 to 90 seconds.

Accordingly, the energy necessary for the transfer can be further reduced, and the productivity of the printed matter can be made more excellent. In addition, the color development property of the printed matter can also be made more excellent.

The adhesion amount of the sublimation transfer ink jet ink adhered to the cloth by the transfer is preferably 1.5 to 6.0 mg/cm$^2$ per unit area of the cloth.

Accordingly, the color development property of the image transferred to the cloth is improved, and in addition, a drying property of the sublimation transfer ink jet ink adhered to the cloth is secured, so that bleeding of the image can be suppressed from being generated.

The transfer medium used in the thermal transfer step is a medium on which the image is formed by the sublimation transfer ink jet ink containing a disperse dye and water.

The formation of the image on the transfer medium is performed by ejecting the sublimation transfer ink jet ink to the transfer medium by an ink jet method.

1-3-1 Transfer Medium

As the transfer medium on which the image is formed by the sublimation transfer ink jet ink, for example, paper, such as regular paper, a recording medium having an ink receiving layer, or the like may be used. The recording medium having an ink receiving layer described above is called, for example, ink jet exclusive paper, coated paper, or the like. In particular, paper having an ink receiving layer which contains inorganic particles, such as silica, is preferable. Accordingly, the transfer medium can be obtained as an intermediate recorded matter which suppress the generation of bleeding and the like on a recorded surface in the process in which the sublimation transfer ink jet ink adhered to the transfer medium is dried. In addition, when the medium as described above is used, the disperse dye is likely to stay on the recorded surface, and in the thermal transfer step, the sublimation of the disperse dye can be more efficiently performed.

1-3-2 Sublimation Transfer Ink Jet Ink

The sublimation transfer ink jet ink used to form the image on the transfer medium is an ink containing a disperse dye and water.

When the image is formed on the transfer medium, at least two types of sublimation transfer ink jet inks may also be used.

Accordingly, for example, a color gamut to be displayed can be increased.

1-3-2-1 Disperse Dye

The sublimation transfer ink jet ink contains a disperse dye.

Accordingly, an excellent color development property can be obtained on the cloth.

In the sublimation transfer ink jet ink, the disperse dye is contained, in general, in the form of particles and is dispersed in a dispersion medium. In addition, in general, the disperse dye is a non-ionic dye having a hydrophilic group and an appropriate polar group. The disperse dye may be used alone, or at least two types thereof may be used in combination.

As the disperse dye, for example, there may be mentioned a C.I. Disperse Yellow, a C.I. Disperse Red, a C.I. Disperse Blue, a C.I. Disperse Orange, a C.I. Disperse Violet, a C.I. Disperse Green, a C.I. Disperse Brown, or a C.I. Disperse Black.

In more particular, for example, there may be mentioned C.I. Disperse Yellow 3, 7, 8, 23, 39, 51, 54, 60, 71, or 86; C.I. Disperse Red 11, 50, 53, 55, 55:1, 59, 60, 65, 70, 75, 93, 146, 158, 190, 190:1, 207, 239, or 240; C.I. Disperse Blue 14, 19, 26, 26:1, 35, 55, 56, 58, 64, 64:1, 72, 72:1, 81, 81:1, 91, 95, 108, 131, 141, 145, or 359; C.I. Disperse Orange 1, 1:1, 5, 20, 25, 25:1, 33, 56, or 76; C.I. Disperse Violet 8, 17, 23, 27, 28, 29, 36, or 57; or C.I. Disperse Brown 2.

In the present disclosure, since more preferable dyeing characteristics can be imparted to the cloth to which the pre-treatment liquid is adhered, and a printed matter having a sufficient color development property can be obtained, a cyan dye, a red dye, and/or a yellow dye is preferable. In addition, since more preferable dyeing characteristics are obtained, and a printed matter having a sufficient color development property can be obtained, as the cyan dye, C.I. Disperse Blue 359 is more preferable. As the red dye, C.I. Disperse Red 60 is more preferable. As the yellow dye, C.I. Disperse Yellow 54 is more preferable.

A content of the disperse dye in the sublimation transfer ink jet ink is preferably 0.05 to 20 percent by mass.

1-3-2-2 Water

The sublimation transfer ink jet ink contains water.

The water is primarily a component to impart fluidity to the sublimation transfer ink jet ink.

After the sublimation transfer ink jet ink is adhered to the transfer medium, the water is mostly evaporated and scattered.

As the water, for example, there may be mentioned pure water, such as ion exchange water, ultrafiltration water, reverse osmosis water, or distilled water, or water, such as ultrapure water, in which ionic impurities are removed as much as possible. In addition, when the sublimation transfer ink jet ink is stored for a long time, water sterilized by UV radiation, addition of hydrogen peroxide, or the like is preferable since generation of fungi and bacteria can be suppressed.

A content of the water in the sublimation transfer ink jet ink is preferably 30.0 to 80.0 percent by mass.

1-3-2-3 Dispersant

The sublimation transfer ink jet ink may further contain a dispersant.

Accordingly, a dispersibility of the disperse dye is improved, and a storage stability of the sublimation transfer ink jet ink and an ejection stability thereof by an ink jet method can be made more excellent.

As the dispersant, for example, a sodium naphthalene sulfonate/formalin condensate or a resin may be mentioned.

The sodium naphthalene sulfonate/formalin condensate is a compound obtained by formalin condensation of a sulfonated compound having a naphthalene ring in its molecule or a salt of the compound described above. The dispersant may be used alone, or at least two types thereof may be used in combination.

When a resin used as the dispersant is contained, as the resin, for example, there may be mentioned an urethane-based resin, a styrene-acrylic-based resin, an acrylic-based resin, a fluorene-based resin, a polyolefin-based resin, a rosin-modified resin, a terpene-based resin, a polyester-based resin, a polyamide-based resin, an epoxy-based resin, a vinyl chloride-based resin, a vinyl chloride-vinyl acetate copolymer, or an ethylene vinyl acetate-based resin, and at least one selected from those mentioned above may be used in combination. However, in particular, an urethane-based resin or a styrene-acrylic-based resin is preferable, and a styrene-acrylic-based resin is more preferable.

Accordingly, the dispersibility of the disperse dye is further improved, and the storage stability of the sublimation transfer ink jet ink and the ejection stability thereof by an ink jet method can also be made further excellent.

As the urethane-based resin, a resin is not particularly limited as long as having an urethane bond in its molecule. As the urethane-based resin, for example, there may be mentioned a polyether type urethane resin having, besides an urethane bond, an ether bond in its main chain, a polyester type urethane resin having, besides an urethane bond, an ester bond in its main chain, or a polycarbonate type urethane resin having, besides an urethane bond, a carbonate bond in its main chain. The urethane-based resin may be used alone, or at least two types thereof may be used in combination.

As the urethane-based resin, a commercial product may also be used. As the commercial product, for example, there may be mentioned Takelac (registered trademark) W6110 (trade name, manufactured by Mitsui Chemicals, Inc.); Acrit (registered trademark) WBR-022U (trade name, manufactured by Taisei Fine Chemical Co., Ltd.); Permarin (registered trademark) UX-368T (trade name), Uprene (registered trademark) UXA-307 (trade name), or Ucoat (registered trademark) UWS-145 (trade name) (each manufactured by Sanyo Chemical Industries, Ltd.); or Solsperse (registered trademark) 47000 (trade name, manufactured by Lubrizol).

As the styrene-acrylic-based resin, for example, there may be mentioned a styrene-acrylic acid copolymer, a styrene-methacrylic acid copolymer, a styrene-methacrylic acid-acrylic acid ester copolymer, a styrene-α-methylstyrene-acrylic acid copolymer, or a styrene-α-methylstyrene-acrylic acid-acrylic acid ester copolymer.

Those copolymers each may be, for example, a random copolymer, a block copolymer, an alternate copolymer, or a graft copolymer.

As the styrene-acrylic-based resin, a commercial product may also be used. As the commercial product, for example, there may be mentioned Joncryl (registered trademark) 67 (trade name, manufactured by BASF Japan Ltd.) or Solsperse (registered trademark) 43000 (trade name, manufactured by Lubrizol).

A content of the dispersant in the sublimation transfer ink jet ink is preferably 3.0 to 8.0 percent by mass.

1-3-2-4 Surfactant

The sublimation transfer ink jet ink may further contain a surfactant.

As the surfactant, for example, there may be mentioned an acetylene glycol-based surfactant, a fluorine-based surfactant, or a silicone-based surfactant. The surfactant may be used alone, or at least two types thereof may be used in combination.

As the acetylene glycol-based surfactant, for example, 2,4,7,9-tetramethyl-5-decyne-4,7-diol, an alkylene oxide adduct thereof, 2,4-dimethyl-5-decyne-4-ol, or an alkylene oxide adduct thereof may be mentioned.

As the acetylene glycol-based surfactant, a commercial product may also be used. As the commercial product, for example, there may be mentioned Olfine (registered trademark) 104 series (trade name) or E series (trade name) manufactured by Nissin Chemical Industry Co., Ltd., or Surfynol (registered trademark) series (trade name) manufactured by Air Products & Chemicals Inc.

As the fluorine-based surfactant, for example, there may be mentioned a perfluoroalkyl sulfonate salt, a perfluoroalkyl carboxylate salt, a perfluoroalkyl phosphate ester, a perfluoroalkyl ethylene oxide adduct, a perfluoroalkyl betaine, or a perfluoroalkylamine oxide compound.

As the fluorine-based surfactant, a commercial product may also be used. As the commercial product, for example, there may be mentioned S-144 (trade name) or S-145 (trade name) manufactured by AGC Inc.

As the silicone-based surfactant, for example, a polysiloxane-based compound or a polyether modified organosiloxane may be mentioned.

As the silicone-based surfactant, a commercial product may also be used. As the commercial product, for example, there may be mentioned BYK (registered trademark) series, 306, 307, 333, 341, 345, 346, 347, 348, or 349 (trade name, manufactured by BYK Japan KK).

A content of the surfactant in the sublimation transfer ink jet ink is preferably 0.5 to 5.0 percent by mass.

1-3-2-5 Water-Soluble Organic Solvent

The sublimation transfer ink jet ink may further contain a water-soluble organic solvent.

As the water-soluble organic solvent, for example, there may be mentioned glycerin; a glycol, such as ethylene glycol, diethylene glycol, triethylene glycol, propylene glycol, dipropylene glycol, 1,3-propanediol, 1,2-butanediol, 1,2-pentanediol, 1,2-hexanediol, 1,4-butanediol, 1,5-pentanediol, or 1,6-hexanediol; a glycol monoether, such as ethylene glycol monomethyl ether, ethylene glycol monoethyl ether, diethylene glycol monomethyl ether, diethylene glycol monoethyl ether, propylene glycol monomethyl ether, propylene glycol monoethyl ether, dipropylene glycol monomethyl ether, dipropylene glycol monoethyl ether, or triethylene glycol monomethyl ether; a nitrogen-containing solvent, such as 2-pyrrolidone, N-methyl-2-pyrollidone, or N-ethyl-2-pyrrolidone; or an alcohol, such as methanol, ethanol, n-propyl alcohol, iso-propyl alcohol, n-butanol, 2-butanol, tert-butanol, iso-butanol, n-pentanol, 2-pentanol, 3-pentanol, or tert-pentanol.

The water-soluble organic solvent may be used alone, or at least two types thereof may be used in combination.

Glycerin, a glycol, or a glycol monoether is able to function primarily as a permeation solvent and/or a moisturizing agent. A glycol monoether tends to have a strong property as the permeation solvent, and glycerin and a glycol tend to have a strong property as the moisturizing agent.

A content of the water-soluble organic solvent in the sublimation transfer ink jet ink is preferably 5.0 to 30.0 percent by mass.

1-3-2-6 Other Components

The sublimation transfer ink jet ink may further contain components other than those described above. Hereinafter, the components as described above are called "other components" in this section.

As the other components, for example, there may be mentioned a solubilizing agent, a viscosity adjuster, a pH adjuster, an antioxidant, an antiseptic agent, a fungicide, a corrosion inhibitor, and/or a chelating agent.

However, a content of the other components in the sublimation transfer ink jet ink is preferably 10.0 percent by mass or less, more preferably 7.0 percent by mass or less, and further preferably 5.0 percent by mass or less.

1-3-3 Preparation Method of Sublimation Transfer Ink Jet Ink

The sublimation transfer ink jet ink can be prepared by mixing a disperse dye and water together with, if needed, components other than those mentioned above in an arbitrary order.

The mixture thus obtained may be treated, if needed, by filtration or the like to remove impurities and foreign substances.

As a mixing method of the components, for example, there may be used a method in which the components are sequentially charged in a container equipped with a stirring device, such as a mechanical stirrer or a magnetic stirrer, and are then stirred and mixed together. As a filtration method, for example, a centrifugal filtration or a filter filtration may be mentioned.

2 Printed Matter

Next, a printed matter according to the present disclosure will be described.

The printed matter according to the present disclosure is a printed matter manufactured by the printing method of the present disclosure described above.

The printed matter according to the present disclosure is excellent in color development property and texture. In particular, since the printing method of the present disclosure is able to preferably perform printing on various types of cloths, for example, while the texture and material feeling of the various types of cloths are maintained, the printed matter according to the present disclosure can obtain an excellent color development property.

Heretofore, although the preferable embodiments of the present disclosure have been described, the present disclosure is not limited thereto.

For example, the printing method of the present disclosure may further include, besides the pre-treatment liquid adhesion step and the thermal transfer step described above, other steps. As the steps as described above, for example, a per-treatment step performed on the cloth before the pre-treatment liquid adhesion step, an intermediate treatment step performed between the pre-treatment liquid adhesion step and the thermal transfer step, and/or a post-treatment step performed after the thermal transfer step may be mentioned.

EXAMPLES

Next, concrete examples of the present disclosure will be described. The present disclosure is not at all limited to the following Examples.

3 Preparation of Pre-Treatment Liquid

Preparation Example A1

Components were charged in a mixture tank and then mixed and stirred by a stirrer for 2 hours. Subsequently, by a filtration using a membrane filter having a pore diameter of 5 μm, a pre-treatment liquid having the composition shown in FIG. 1 was obtained.

Preparation Examples A2 to A6

Except for that the types of components to be used and the use amounts thereof were set to form the compositions shown in FIG. 1, pre-treatment liquids were each prepared in a manner similar to that of the above Preparation Example A1.

In addition, in FIG. 1, the numerical value of each component represents the content thereof on a percent by mass basis.

In addition, the components shown in FIG. 1 are as described below.

Polyester Resin

KT-8803: Solid content of Elitel (registered trademark) KT-8803 (trade name, manufactured by Unitika Ltd., solid content: 30 percent by mass, glass transition temperature Tg: 65° C.)

KT-8701: Solid content of Elitel (registered trademark) KT-8701 (trade name, manufactured by Unitika Ltd., solid content: 30 percent by mass, glass transition temperature Tg: 15° C.)

Cross-Linking Agent

#220: Solid content of Fixer #220 (trade name, manufactured by Murayama Chemical Laboratory Co., Ltd., isocyanate group-containing compound having an isocyanurate skeleton in its structure, solid content: 40 percent by mass)

K-2035E: Solid content of Epocros (registered trademark) K-2035E (trade name, manufactured by Nippon Shokubai Co., Ltd., oxazoline group-containing compound, solid content: 40 percent by mass)

4 Preparation of Sublimation Transfer Ink Jet Ink

Preparation Example B1

Components were charged in a mixture tank and then mixed and stirred by a stirrer for 2 hours. Subsequently, by a filtration using a membrane filter having a pore diameter of 1 μm, a sublimation transfer ink jet ink having the composition shown in FIG. 2 was obtained.

In addition, in FIG. 2, the numerical value of each component represents the content thereof on a percent by mass basis.

In addition, the components shown in FIG. 2 are as described below.

Disperse Dye

DB359: C.I. Disperse Blue 359 (commercial product)

Surfactant

BYK(R)-348: BYK (registered trademark)-348 (trade name, silicone-based surfactant, manufactured by BYK Japan KK)

5 Manufacturing of Printed Matter

Example 1

By the use of the pre-treatment liquid prepared in Preparation Example A1, a cloth to which the pre-treatment liquid was adhered was obtained as described below. That is, cotton in the form of a cloth having a water absorbability of 0.9 [s] was immersed in the pre-treatment liquid, and the pre-treatment liquid was applied to the cloth by a mangle roller so that the adhesion amount of the polyester resin contained in the pre-treatment liquid to the cloth was 10 [g/m$^2$]. Subsequently, by the use of a heat press machine TP-608M (trade name, manufactured by Taiyo Seiki), the cloth was dried under conditions at a temperature of 200° C. and a pressure of 4.2 N/cm$^3$, so that the cloth to which the pre-treatment liquid was adhered was obtained.

On the other hand, by the use of the sublimation transfer ink jet ink prepared in Preparation Example B1, as described below, a transfer medium on which an image was formed by the sublimation transfer ink jet ink was obtained. That is, the sublimation transfer ink jet ink was filled in a cartridge of an ink jet printer PX-G930 (trade name, manufactured by Seiko Epson Corporation). Subsequently, on a coated layer of coated paper (TRANSJET Sportsline 1254 (trade name, manufactured by Chem Paper) used as the transfer medium, the sublimation transfer ink jet ink was adhered in an ink ejection amount of 12 mg/inch$^2$ at a resolution of 720 dpi×720 dpi and at a duty of 100%, so that an image having a solid pattern was formed. Accordingly, a transfer medium on which the image was formed by the sublimation transfer ink jet ink was obtained.

The surface of the transfer medium on which the image was formed as described above and the cloth to which the pre-treatment liquid obtained as described above was adhered were overlapped so as to face each other, and by the use of a heat press machine TP-608M (trade name, manufactured by Taiyo Seiki), the thermal transfer was performed under conditions at a temperature of 200° C. and a pressure of 4.2 N/cm$^3$ for 60 seconds, so that a printed matter was obtained.

Examples 2 to 22

Except for that the types of pre-treatment liquids, the conditions of the cloths, and the adhesion amounts [g/m$^2$] of the polyester resins to the cloths were set as shown in FIGS. 3 and 4, printed matters were each manufactured in a manner similar to that of the above Example 1.

Comparative Examples 1 to 9

Except for that the types of pre-treatment liquids, the conditions of the cloths, and the adhesion amounts [g/m$^2$] of the polyester resins to the cloths were set as shown in FIG. 4, printed matters were manufactured in a manner similar to that of the above Example 1.

6 Evaluation

The following evaluations were performed on the printed matters of the above Examples and Comparative Examples.

6-1 Color Development Property

An OD value of a recorded surface of the printed matter of each of the above Examples and Comparative Examples immediately after manufacturing, that is, an OD value of the surface of the printed matter which faced the transfer medium during the manufacturing of the printed matter, was measured using an optical densitometer FD-7 (manufactured by Konica Minolta, Inc.) with a light source D65 and at a viewing angle of 2° and was then evaluated in accordance with the following criteria.

A: OD value of recorded surface is 1.1 or more.

B: OD value of recorded surface is 1.0 to less than 1.1.

C: OD value of recorded surface is 0.9 to less than 1.0.

D: OD value of recorded surface is 0.8 to less than 0.9.

E: OD value of recorded surface is less than 0.8.

6-2 Texture

The texture of the printed matter of each of the above Examples and Comparative Examples was evaluated by a sensory test. In particular, the printed matter thus obtained was evaluated by arbitrarily selected five judges into two classes, "touch feeling is not inferior to that of original cloth" and "printed matter is stiff, and touch feeling is inferior to that of the original cloth", and in accordance with the result thereof and the following evaluation criteria, the texture was evaluated. When the evaluation result was B or higher, the texture was regarded as excellent.

A: Five judges respond that "touch feeling is not inferior to that of original cloth".

B: Four judges respond that "touch feeling is not inferior to that of original cloth".

C: Three judges respond that "touch feeling is not inferior to that of original cloth".

D: One or two judges respond that "touch feeling is not inferior to that of original cloth".

E: No judges respond that "touch feeling is not inferior to that of original cloth".

6-3 Discoloration With Time

The D65 light source was allowed to further continuously radiate light for 24 hours from the measurement of the OD value described in the above 6-1.

Subsequently, the OD value of each printed matter thus processed was measured in a manner similar to that described in the above 6-1.

In addition, the measurement value of the OD value in the above 6-1 was represented by OD0, and the measurement value of the OD value obtained by further continuous radiation of light of the D65 light source for 24 hours from the measurement of the OD value in the above 6-1 was represented by OD1. Subsequently, a discoloration rate with time (%) represented by $\{(OD1/OD0)-1\}\times 100$ was obtained and then evaluated in accordance with the following criteria.

A: Discoloration rate with time is −1% or more.

B: Discoloration rate with time is −2% to less than −1%.

C: Discoloration rate with time is −4% to less than −2%.

D: Discoloration rate with time is −6% to less than −4%.

E: Discoloration rate with time is less than −6%.

Those results and the manufacturing conditions of the printed matters of the above Examples and Comparative Examples are collectively shown in FIGS. 3 and 4.

In addition, in FIGS. 3 and 4, a cloth for a cotton T shirt having a water absorbability of 0.9 [s], a cloth for a cotton T shirt having a water absorbability of 1.3 [s], and a cloth for a cotton T shirt having a water absorbability of 5.4 [s] are represented by "F1", "F2", and "F3", respectively.

As apparent from FIGS. 3 and 4, in the above Examples, excellent results are obtained. On the other hand, in Comparative Examples, satisfactory results cannot be obtained.

In addition, except for that the content of the cross-linking agent in the pre-treatment liquid was variously changed in a range of from 0.1 to 5.0 percent by mass, when printed matters were manufactured in a manner similar to that of each Example and were then evaluated in a manner similar to that described above, results similar to those described above were obtained.

What is claimed is:

1. A printing method comprising:

a pre-treatment liquid adhesion step of adhering a pre-treatment liquid to a cloth; and a thermal transfer step in which while a transfer medium on which an image is formed by a sublimation transfer ink jet ink containing a disperse dye and water is faced to the cloth to which the pre-treatment liquid is adhered, the image is thermal-transferred to the cloth, wherein the pre-treatment liquid contains a polyester resin, a cross-linking agent, and water, and in the pre-treatment liquid adhesion step, the pre-treatment liquid is adhered to the cloth so that a product of a water absorbability [s] of the cloth obtained by the sedimentation method in accordance with JIS L 1907: 2010 7.1.3 and an adhesion amount [$g/m^2$] of the polyester resin to the cloth is 8.0 to 16.0 [$s\cdot g/m^2$].

2. The printing method according to claim 1, wherein the polyester resin has a glass transition temperature of 25° C. or more.

3. The printing method according to claim 1, wherein the cross-linking agent includes an isocyanate group-containing compound.

4. The printing method according to claim 1, wherein the pre-treatment liquid further contains an organic solvent.

5. The printing method according to claim 1, wherein the cloth contains fibers formed of a material having a hydroxy group.

6. The printing method according to claim 1, wherein a content of the polyester resin in the pre-treatment liquid is 1.0 to 20.0 percent by mass.

7. The printing method according to claim 1, wherein a content of the cross-linking agent in the pre-treatment liquid is 0.1 to 5.0 percent by mass.

* * * * *